US006916083B2

(12) United States Patent
Miller et al.

(10) Patent No.: US 6,916,083 B2
(45) Date of Patent: Jul. 12, 2005

(54) CONTROL OVER FLOW OF AN ACOUSTIC COUPLING FLUID

(75) Inventors: Michael F. Miller, Mountain View, CA (US); Glen Krueger, San Jose, CA (US); Lawrence Lee, Jr., Sunnyvale, CA (US); David S. Lee, La Mirada, CA (US)

(73) Assignee: Labcyte Inc., Sunnyvale, CA (US)

( * ) Notice: Subject to any disclaimer, the term of this patent is extended or adjusted under 35 U.S.C. 154(b) by 98 days.

(21) Appl. No.: 10/668,534

(22) Filed: Sep. 22, 2003

(65) Prior Publication Data

US 2005/0061078 A1 Mar. 24, 2005

(51) Int. Cl.[7] ..... B41J 2/135
(52) U.S. Cl. ..... 347/46
(58) Field of Search ..... 347/46, 47, 48, 347/1, 5, 9, 7, 20, 32, 22, 35, 36, 27, 19

(56) References Cited

U.S. PATENT DOCUMENTS 5,469,744 A 11/1995 Patton et al.
5,520,715 A 5/1996 Oeftering
6,416,164 B1 7/2002 Stearns et al.
2002/0037579 A1 3/2002 Ellson et al.
2002/0094582 A1 7/2002 Williams
2003/0101819 A1 6/2003 Mutz et al.
2003/0150257 A1 8/2003 Mutz et al.

*Primary Examiner*—Raquel Yvette Gordon
(74) *Attorney, Agent, or Firm*—Reed Intellectual Property Law Group

(57) ABSTRACT

An acoustic device is provided comprising a reservoir adapted to contain a fluid and having an exterior surface, an acoustic radiation generator for generating acoustic radiation, and a means for delivering an acoustic coupling fluid to the exterior surface of the reservoir. The acoustic radiation generator is placed in acoustic coupling relationship via the acoustic coupling fluid to the reservoir. Acoustic radiation generated by the acoustic radiation generator is transmitted through the exterior surface and into any fluid contained in the reservoir. Uncontrolled flow of the acoustic coupling fluid at the exterior surface as a result of movement of the acoustic radiation generator is eliminated. Also provided are methods that eliminate such uncontrolled flow.

60 Claims, 5 Drawing Sheets

CONTROL OVER FLOW OF AN ACOUSTIC COUPLING FLUID

TECHNICAL FIELD

The invention relates generally to devices and methods that provide control over the placement and flow of acoustic coupling fluid between an acoustic generator and a reservoir. More particularly, the invention provides a means for controlling flow of the acoustic coupling fluid at an exterior surface of a reservoir due to relative movement between the reservoir and the acoustic radiation generator.

BACKGROUND

High-speed combinatorial methods often involve the use of array technologies that require accurate dispensing of fluids. In order to carry out combinatorial techniques, numerous fluid dispensing techniques have been explored, such as pin spotting, pipetting, inkjet printing, and acoustic ejection. Acoustic ejection provides a number of advantages over other fluid dispensing technologies. In contrast to inkjet devices, nozzleless fluid ejection devices are not subject to clogging and their associated disadvantages, e.g., misdirected fluid or improperly sized droplets. Furthermore, acoustic technology does not require the use of capillaries or involve invasive mechanical actions, for example, those associated with the introduction of a pipette tip into a reservoir of fluid.

Acoustic ejection has been described in a number of patents and may be used to dispense a plurality of fluids at high speeds and with great accuracy. For example, U.S. Patent Application Publication Ser. No. 20020037579 to Ellson et al. describes a device for acoustically ejecting a plurality of fluid droplets toward discrete sites on a substrate surface for deposition thereon. The device includes an acoustic radiation generator for generating acoustic and a focusing means, e.g., a curved surface, for focusing acoustic radiation generated by the generator. In operation, the acoustic generator is acoustically coupled to the reservoir and activated to generate acoustic radiation. The focusing means then focuses the generated acoustic radiation at a point near a free fluid surface within the fluid contained in the reservoir. As a result, a fluid droplet is ejected from reservoir.

Acoustic radiation may also be used to assess the contents of one or more reservoirs. For example, the device described in U.S. Patent Application Publication No. 20020037579 to Ellson et al. may also be used to produce a detection acoustic wave that is transmitted to the fluid surface of the reservoir to become a reflected acoustic wave. Characteristics of the reflected acoustic radiation may then be analyzed in order to assess the spatial relationship between the acoustic radiation generator and the fluid surface. In addition, pool depth feedback technology using acoustic radiation is described in U.S. Pat. No. 5,520,715 to Oeftering. Furthermore, U.S. Patent Application Publication No. 20020094582 to Williams describes similar acoustic ejection and detection technology. In some instances, detailed information relating to the contents of fluid in reservoirs may be obtained. For example, U.S. Patent Application Publication Nos. 20030101819 and 20030150257, each to Mutz et al., describe devices and methods for acoustically assessing the contents in a plurality of reservoirs.

As discussed above, when acoustic radiation is used to analyze the contents of a reservoir or to eject a fluid droplet therefrom, a generator for generating acoustic radiation is placed in acoustic coupling relationship with the reservoir.

Although the generator may be placed within the reservoir to establish acoustic coupling, e.g., submerged in a fluid contained in the reservoir, submersion is undesirable when the acoustic generator is used to eject different fluids in rapid succession. Cleaning would be required to avoid contamination between the fluids. Thus, a preferred approach is to couple the generator to an exterior surface of the reservoir and to avoid placing the generator in the reservoir. As a result, the generator does not contact any fluid that the reservoir may contain.

For example, acoustic coupling may be achieved between an acoustic generator and a reservoir via an acoustic coupling medium. As described in U.S. Patent Application Publication No. 20020037579, such a coupling medium allows transmission of acoustic radiation therethrough and into the reservoir. Preferably, the acoustic coupling medium is an acoustically homogeneous fluid in conformal contact with both acoustic generator and the reservoir.

When a single acoustic radiation generator is used in conjunction with a plurality of reservoirs, the generator may be placed in acoustic coupling relationship in rapid succession to each of the reservoirs via the acoustic coupling fluid. Accordingly, the generator, the reservoirs, or both must be rapidly displaced with respect to each other for high-throughput techniques. Such rapid movement may cause uncontrolled flow of the acoustic coupling fluid. As a result, conformal contact between the acoustic generator and the reservoirs may not be achieved, thereby compromising the performance of the device. In some instances, uncontrolled acoustic fluid flow may result in the contamination of the reservoir contents, presence of sound-reflecting bubbles in the acoustic path, and/or degradation of device components.

Thus, there is a need in the art for improved methods and devices that are capable of high-speed monitoring and or ejection of fluid in a plurality of reservoirs within improved control over the placement and flow of acoustic coupling fluid between an acoustic generator and a reservoir.

SUMMARY OF THE INVENTION

An acoustic device is provided comprising a reservoir adapted to contain a fluid and having an exterior surface, an acoustic radiation generator for generating acoustic radiation, and a means for delivering an acoustic coupling fluid to the exterior surface of the reservoir. Also provided is a means for positioning the acoustic radiation generator in acoustic coupling relationship via the acoustic coupling fluid to the reservoir. Acoustic radiation generated by the acoustic radiation generator is transmitted through the exterior surface and into any fluid contained in the reservoir. Also provided is a means for eliminating uncontrolled flow of the acoustic coupling fluid at the exterior surface due to movement of the acoustic radiation generator. The device may be adapted to assess the contents of the reservoir and/or to eject a fluid droplet from the reservoir.

Typically, the means for delivering the acoustic coupling fluid is comprised of a nozzle in communication with a source of acoustic coupling fluid. In some instances, the means for eliminating uncontrolled flow of the acoustic coupling fluid comprises a displacement member that maintains the acoustic coupling fluid at a constant volume within the nozzle in response to any movement of the acoustic radiation generator within the nozzle. For example, displacement member may be a piston or a diaphragm. In addition or in the alterative, the means for eliminating uncontrolled flow of the acoustic coupling fluid may be comprised of a flow rate regulator that adjusts the flow rate of the acoustic coupling fluid from the source to the outlet according to movement of the acoustic radiation generator within the nozzle. For example, the flow rate regulator may be comprised of an adjustable valve located downstream from the source and upstream from the outlet.

The means for delivering the acoustic coupling fluid may alternatively be comprised of a container sealed against the reservoir and filled with the acoustic coupling fluid such that the acoustic coupling fluid is in conformal contact with the exterior surface of the reservoir. In such a case, the acoustic radiation generator may be movable within the container.

Water may be used advantageously as the acoustic coupling fluid or a component thereof. Alternatively, the acoustic coupling fluid may be comprised of a nonaqueous fluid that exhibits an attenuation coefficient for acoustic radiation of a selected frequency similar to or less than the attenuation coefficient of water at the same frequency.

Also provided is a method for transmitting acoustic radiation into a reservoir. The method involves simultaneously delivering an acoustic coupling fluid to an exterior surface of a reservoir adapted to contain a fluid and positioning an acoustic radiation generator for generating acoustic radiation in acoustic coupling relationship via the acoustic coupling fluid to the reservoir. The acoustic radiation generator is activated to generate and transmit acoustic radiation through the exterior surface and into any fluid contained in the reservoir. Uncontrolled flow of the acoustic coupling fluid at the exterior surface of the reservoir is avoided. The method, like the inventive device, may also be used to assess the contents of the reservoir and/or to eject a fluid droplet from the reservoir.

BRIEF DESCRIPTION OF THE DRAWINGS

FIG. 1A shows the acoustic unit acoustically coupled to the first reservoir so that the unit is activated to determine the position of the free fluid surface within the first reservoir. FIG. 1B depicts the repositioning of the acoustic unit toward the reservoir and the activation acoustic unit in order to eject a droplet of fluid from within the first reservoir toward a site on a substrate surface to form an array. FIG. 1C shows the acoustic unit acoustically coupled to the second reservoir so that the unit is activated to determine the position of the free fluid surface within the second reservoir. FIG. 1D depicts the repositioning of the acoustic unit away from the reservoir and the activation acoustic unit in order to eject a droplet of fluid from within the second reservoir toward a site on a substrate surface.

DETAILED DESCRIPTION OF THE INVENTION

Figure 1A:
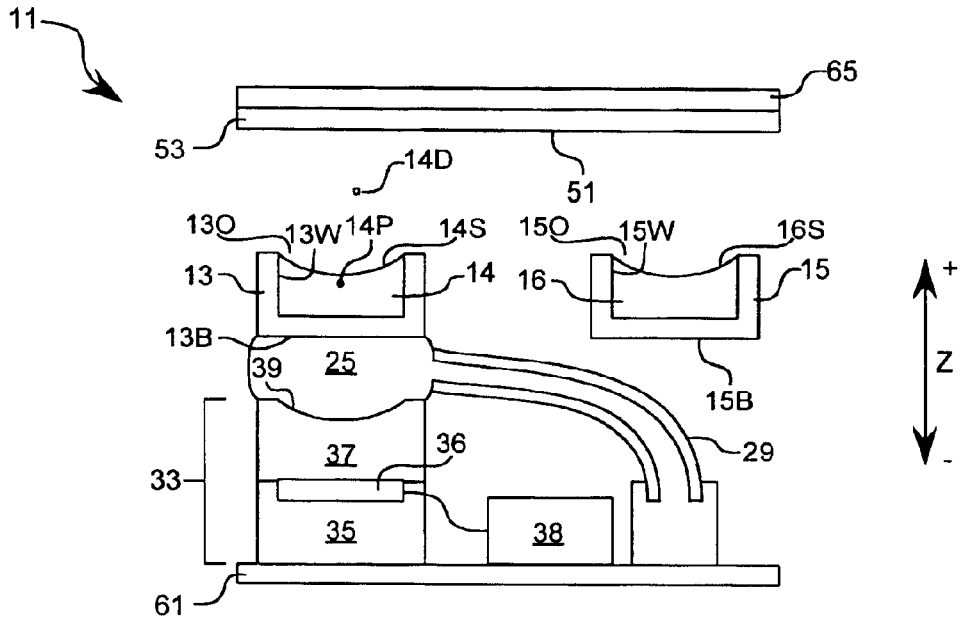
FIGS. 1A–1D, collectively referred to as FIG. 1, schematically illustrate in simplified cross-sectional view a known device and the disadvantages associated therewith. As depicted, the device comprises first and second reservoirs, a combined acoustic analyzer and ejector unit, and an ejector positioning means.
Figure 1B:
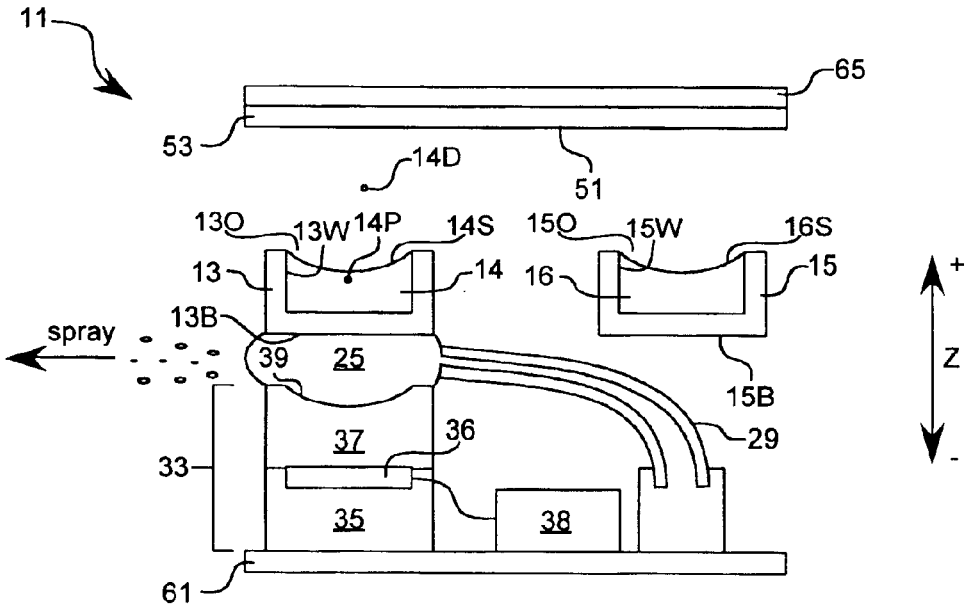

Before describing the present invention in detail, it is to be understood that this invention is not limited to specific fluids, or device structures, as such may vary. It is also to be understood that the terminology used herein is for describing particular embodiments only, and is not intended to be limiting.

It must be noted that, as used in this specification and the appended claims, the singular forms "a," "an," and "the" include plural referents unless the context clearly dictates otherwise. Thus, for example, reference to "a reservoir" includes a single reservoir as well as a plurality of reservoirs, reference to "a fluid" includes a single fluid and a plurality of fluids, reference to "an ejector" includes a single ejector as well as plurality of ejectors and the like.

In describing and claiming the present invention, the following terminology will be used in accordance with the definitions set forth below.

The terms "acoustic coupling" and "acoustically coupled" as used herein refer to a state wherein an object is placed in direct or indirect contact with another object to allow acoustic radiation to be transferred between the objects without substantial loss of acoustic energy. When two entities are indirectly acoustically coupled, an "acoustic coupling medium" is needed to provide an intermediary through which acoustic radiation may be transmitted. Thus, an ejector may be acoustically coupled to a fluid, such as by immersing the ejector in the fluid, or by interposing an acoustic coupling fluid between the ejector and the fluid, in order to transfer acoustic radiation generated by the ejector through the acoustic coupling fluid and into the fluid.

The term "array" as used herein refers to a two-dimensional arrangement of features, such as an arrangement of reservoirs (e.g., wells in a well plate) or an arrangement of different moieties, including ionic, metallic, or covalent crystalline, e.g., molecular crystalline, composite or ceramic, glassine, amorphous, fluidic or molecular materials on a substrate surface (as in an oligonucleotide or peptidic array). Arrays are generally comprised of regular, ordered features, as in, for example, a rectilinear grid, parallel stripes, spirals, and the like, but non-ordered arrays may be advantageously used as well. In particular, the term "rectilinear array" as used herein refers to an array that has rows and columns of features wherein the rows and columns typically, but not necessarily, intersect each other at a ninety-degree angle. An array is distinguished from the more general term "pattern" in that patterns do not necessarily contain regular and ordered features. An array is distinguished from the more general term "pattern" in that patterns do not necessarily contain regular and ordered features.

The term "attenuation" is used herein in its ordinary sense and refers to the decrease in intensity of a wave due to scattering and/or absorption of energy. Typically, attenuation occurs with little or no distortion but does not include intensity reduction due to geometric spreading. Thus, the term "attenuation coefficient" refers to the rate of diminution of wave intensity with respect to distance along a transmission path.

The term "fluid" as used herein refers to matter that is nonsolid, or at least partially gaseous and/or liquid, but not entirely gaseous. A fluid may contain a solid that is minimally, partially, or fully solvated, dispersed, or suspended. Examples of fluids include, without limitation, aqueous liquids (including water per se and salt water) and nonaqueous liquids such as organic solvents and the like. As used herein, the term "fluid" is not synonymous with the term "ink" in that an ink must contain a colorant and may not be gaseous.

The terms "focusing means" and "acoustic focusing means" refer to a means for causing acoustic waves to converge at a focal point, either by a device separate from the acoustic energy source that acts like an optical lens, or by the spatial arrangement of acoustic energy sources to effect convergence of acoustic energy at a focal point by constructive and destructive interference. A focusing means may be as simple as a solid member having a curved surface, or it may include complex structures such as those found in Fresnel lenses, which employ diffraction in order to direct acoustic radiation. Suitable focusing means also include phased array methods as are known in the art and described, for example, in U.S. Pat. No. 5,798,779 to Nakayasu et al. and Amemiya et al. (1997) *Proceedings of the* 1997 *IS&T NIP* 13 *International Conference on Digital Printing Technologies,* pp. 698–702.

"Optional" or "optionally" means that the subsequently described circumstance may or may not occur, so that the description includes instances where the circumstance occurs and instances where it does not.

The term "radiation" is used in its ordinary sense and refers to emission and propagation of energy in the form of a waveform disturbance traveling through a medium such that energy is transferred from one particle of the medium to another without causing any permanent displacement of the medium itself. Thus, radiation may refer, for example, to electromagnetic waveforms as well as acoustic vibrations.

Accordingly, the terms "acoustic radiation" and "acoustic energy" are used interchangeably herein and refer to the emission and propagation of energy in the form of sound waves. As with other waveforms, acoustic radiation may be focused using a focusing means, as discussed below. Although acoustic radiation may have a single frequency and associated wavelength, acoustic radiation may take a form, e.g. a "linear chirp," that includes a plurality of frequencies.

The term "reservoir" as used herein refers to a receptacle or chamber for containing a fluid. In some instances, a fluid contained in a reservoir necessarily will have a free surface, e.g., a surface that allows acoustic radiation to be reflected therefrom or a surface from which a droplet may be acoustically ejected. A reservoir may also be a locus on a substrate surface within which a fluid is constrained.

In general, the invention relates to devices and methods that employ acoustic radiation to manipulate a fluid and/or assess the contents of a fluid reservoir. The acoustic radiation is generated by an acoustic radiation generator acoustically coupled to an exterior surface of a fluid reservoir via an acoustic coupling fluid. Unlike known acoustic methods and devices, a means is provided for eliminating uncontrolled flow of the acoustic coupling fluid at the exterior surface as a result of movement of the acoustic radiation generator.

To elucidate the novel and nonobvious nature of the invention, FIG. 1 depicts a known acoustic device simplified cross-sectional view. The device allows for acoustic assessment of the contents of a plurality of reservoirs as well as acoustic ejection of fluid droplets from the reservoirs. The inventive device is shown in operation to form a biomolecular array bound to a substrate. As with all figures referenced herein, in which like parts are referenced by like numerals, FIG. 1 is not to scale, and certain dimensions may be exaggerated for clarity of presentation. The device 11 includes two reservoirs, with a first reservoir indicated at 13 and a second reservoir indicated at 15. As shown, the first reservoir 13 contains a first fluid 14 and the second reservoir 15 contains a second fluid 16. Fluids 14 and 16 each have a fluid surface respectively indicated at 14S and 16S. Reservoirs 13 and 15 are substantially identical in construction, each being axially symmetric, having vertical walls 13W and 15W extending upward from circular reservoir bases 13B and 15B, and terminating at openings 13O and 15O, respectively. The material and thickness of each reservoir base are such that acoustic radiation may be transmitted therethrough and into the fluid contained within the reservoirs. As depicted, fluids 14 and 16 are of differing volumes and heights. That is, the distance between surface 14S and base 13B is greater than the distance between surface 16S and base 15B.

The device also includes an acoustic ejector 33 comprised of an acoustic radiation generator 35 for generating acoustic radiation and a focusing means 37 for focusing the acoustic radiation at a focal point within the fluid from which a droplet is to be ejected, near the fluid surface. The acoustic radiation generator contains a transducer 36, e.g., a piezoelectric element, commonly shared by an analyzer. As shown, a combination unit 38 is provided that both serves as a controller and a component of an analyzer. Operating as a controller, the combination unit 38 provides the piezoelectric element 36 with electrical energy that is converted into mechanical and acoustic energy. Operating as a component of an analyzer, the combination unit receives and analyzes electrical signals from the transducer. The electrical signals are produced as a result of the absorption and conversion of mechanical and acoustic energy by the transducer.

As shown in FIG. 1, the focusing means 37 is comprised of a single solid piece having a concave surface 39 for focusing acoustic radiation. The acoustic ejector 33 is thus adapted to generate and focus acoustic radiation so as to eject a droplet of fluid from each of the fluid surfaces 17 and 19 when acoustically coupled to reservoirs 13 and 15, and thus to fluids 14 and 16, respectively. The acoustic radiation generator 35 and the focusing means 37 function as a single unit controlled by a single controller.

In operation, as illustrated in FIG. 1A, a dispenser 29 places an acoustic coupling fluid 25 between the ejector 33 and the base 13B of reservoir 13, with the ejector placed at a predetermined distance from each the reservoir by positioning means 61. The dispenser 29 dispenses sufficient coupling fluid 25 so that the fluid established conformal contact between the concave surface 39 and base 13B. Once the ejector, the reservoir, and the substrate are in proper alignment, the acoustic radiation generator 35 is activated to produce acoustic radiation that is directed toward a free fluid surface 14S of the first reservoir. The acoustic radiation will then travel in a generally upward direction toward the free fluid surface 14S. The acoustic radiation will be reflected. By determining the time it takes for the acoustic radiation to be reflected by the fluid surface back to the acoustic radiation generator, and then correlating that time with the speed of sound in the fluid, the distance—and thus the fluid height—may be calculated.

In order to form a biomolecular array on a substrate using the inventive device, substrate 53 is positioned above and in proximity to the first reservoir 13 such that one surface of the substrate, shown in FIG. 1 as underside surface 51, faces the reservoir and is substantially parallel to the surface 14S of the fluid 14 therein. Due to the height of fluid 14, the ejector 33 is moved toward to the reservoir 13 to ensure that the focal point of the ejection acoustic wave is near the fluid surface 14S, where desired. That is, the ejector 33 is moved positively along axis Z. As a result, acoustic coupling fluid 25 is displaced through uncontrollable flow. When movement of the ejector is at a high velocity, the acoustic coupling fluid may be squirted or sprayed in a direction perpendicular to axis Z.

In any case, once the ejector, the reservoir, and the substrate are in proper alignment, the acoustic radiation generator 35 is activated to produce acoustic radiation that is directed by the focusing means 37 to a focal point 14P near the fluid surface 14S of the first reservoir. That is, an ejection acoustic wave having a focal point near the fluid surface is generated in order to eject at least one droplet of the fluid. As a result, droplet 14D is ejected from the fluid surface 14S onto a designated site on the underside surface 51 of the substrate.

Figure 1C:
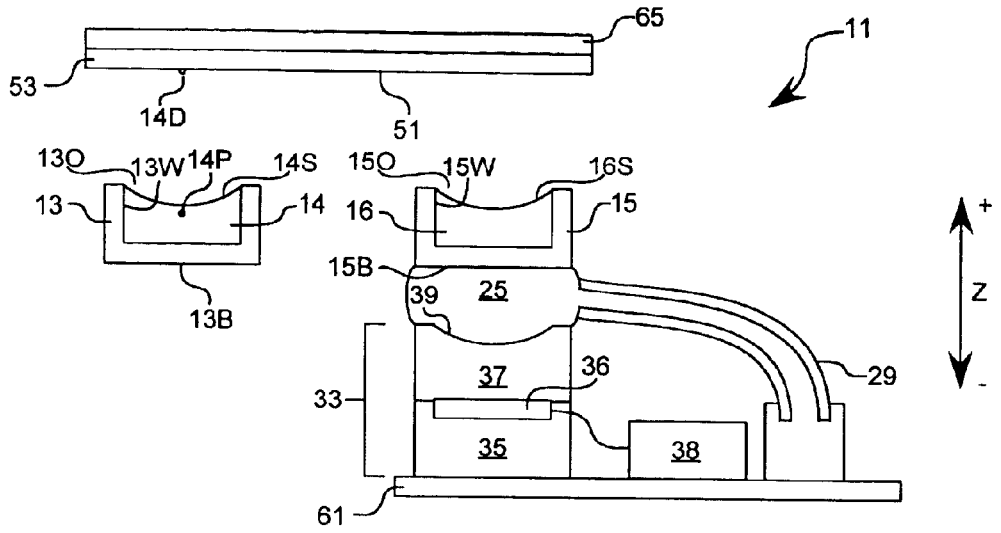
Figure 1D:
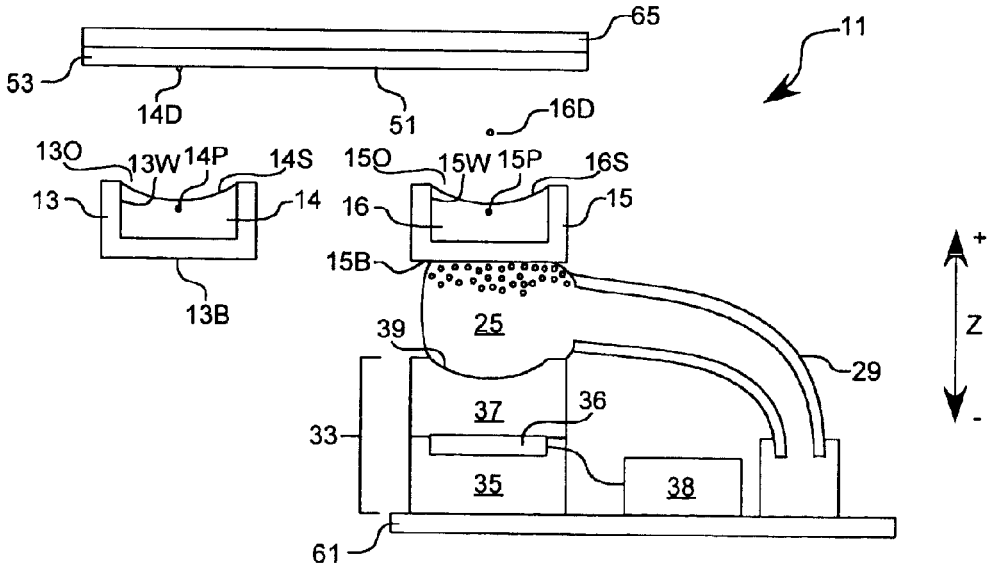

Then, as shown in FIG. 1C, a substrate positioning means 65 repositions the substrate 53 over reservoir 15 in order to receive a droplet therefrom at a second designated site. FIG. 1C also shows that the ejector 33 has been repositioned by the ejector positioning means 61 below reservoir 15 and in acoustically coupled relationship thereto by virtue of acoustic coupling fluid 25. Again, the dispenser 29 dispenses sufficient coupling fluid 25 so that the fluid establishes conformal contact between the concave surface 39 and base 15B. Once properly aligned, the acoustic radiation generator 35 of ejector 33 is activated to produce low energy acoustic radiation to assess the height of fluid 16 in reservoir 15 and to determine whether and/or how to eject fluid from the reservoir.

Due to the height of fluid 16, the ejector 33 is moved away from the reservoir 15 to ensure that the focal point of the ejection acoustic wave is near the fluid surface 16S, where desired. That is, the ejector 33 is moved negatively along axis Z. As a result, acoustic coupling fluid 25 flows uncontrollably so that it no longer conforms to surface 39 and base 15B. In some instances, bubbles will form within the acoustic coupling fluid. For example, air bubbles may be sucked into fluid. Under extreme circumstances, bubbles may be formed as a result of cavitation. Thus, any droplet 16D ejected from reservoir 15 toward substrate 53 may be misdirected due to the lack of conformal contact.

Thus, it should be apparent that uncontrolled flow of the coupling fluid is particularly problematic when the acoustic generator in contact with the coupling fluid is moved rapidly relative to the exterior surface. Correspondingly, when acoustic ejection and/or assessment techniques are carried out that involves use of a single acoustic generator rapidly and successively coupled via an acoustic coupling fluid to a plurality of reservoirs, uncontrolled fluid flow may compromise the viability of the techniques, particularly in the context of high-throughput combinatorial methods.

In one embodiment, then, an acoustic device is provided comprising a reservoir adapted to contain a fluid and having an exterior surface, an acoustic radiation generator for generating acoustic radiation, and a means for delivering an acoustic coupling fluid to the exterior surface of the reservoir. The device also includes a means for positioning the acoustic radiation generator in acoustic coupling relationship via the acoustic coupling fluid to the reservoir such that acoustic radiation generated by the acoustic radiation generator is transmitted through the exterior surface and into any fluid contained in the reservoir. A means is provided for eliminating uncontrolled flow of the acoustic coupling fluid at the exterior surface as a result of movement of the acoustic radiation generator.

Although a single reservoir may be provided, the device typically includes a plurality of reservoirs each adapted to contain a fluid and each having an exterior surface. In such a case, the acoustic radiation generator may be placed successively in acoustic coupling relationship to each of the reservoirs via the acoustic coupling fluid such that acoustic radiation generated by the acoustic radiation generator is transmitted through the exterior surfaces and into any fluid contained in the reservoirs. In addition, reservoirs may be arranged in a pattern or an array to provide each reservoir with individual systematic addressability. Although any type of array may be employed, arrays comprised of parallel rows of evenly spaced reservoirs are preferred. Typically, though not necessarily, each row contains the same number of reservoirs. Optimally, rectilinear arrays comprising X rows and Y columns of reservoirs are employed with the invention, wherein X and Y are each at least 2. In addition, nonrectilinear arrays as well as other geometries may be employed. For example, hexagonal, spiral and other types of arrays may be used as well.

For example, the reservoirs may represent individual wells in a well plate, and the exterior surfaces form a substantially planar underside surface of the well plate. Many well plates suitable for use with the device are commercially available and may contain, for example, 96, 384, 1536, or 3456 wells per well plate, having a full skirt, half skirt, or no skirt. The wells of such well plates typically form rectilinear arrays. Manufactures of suitable well plates for use in the employed device include Corning, Inc. (Corning, N.Y.) and Greiner America, Inc. (Lake Mary, Fla.). However, the availability of such commercially available well plates does not preclude the manufacture and use of custom-made well plates containing at least about 10,000 wells, or as many as 100,000 to 500,000 wells, or more. The wells of such custom-made well plates may form rectilinear or other types of arrays. As well plates have become commonly used laboratory items, the Society for Biomolecular Screening (Danbury, Conn.) has formed the Microplate Standards Development Committee to recommend and maintain standards to facilitate the automated processing of small volume well plates on behalf of and for acceptance by the American National Standards Institute.

Reservoirs may be included as an integrated or permanently attached component of the device. However, to provide modularity and interchangeability of components, it is preferred that device be constructed with removable reservoirs. In addition, while each of the reservoirs may be provided as a discrete or stand-alone item, in circumstances that require a large number of reservoirs, it is preferred that the reservoirs be attached to each other or represent integrated portions of a single reservoir unit, e.g., a well plate as discussed above.

Furthermore, the material used in the construction of reservoirs must be compatible with the fluids contained therein. Thus, if it is intended that the reservoirs or wells contain an organic solvent such as acetonitrile, polymers that dissolve or swell in acetonitrile would be unsuitable for use in forming the reservoirs or well plates. Similarly, reservoirs or wells intended to contain DMSO must be compatible with DMSO. For water-based fluids, a number of materials are suitable for the construction of reservoirs and include, but are not limited to, ceramics such as silicon oxide and aluminum oxide, metals such as stainless steel and platinum, and polymers such as polyester and polytetrafluoroethylene. For fluids that are photosensitive, the reservoirs may be constructed from an optically opaque material that has sufficient acoustic transparency for substantially unimpaired functioning of the device.

In addition, to reduce the amount of movement and time needed to align the acoustic radiation generator with each reservoir or reservoir well during operation, it is preferable that the center of each reservoir be located not more than about 1 centimeter, more preferably not more than about 1.5 millimeters, still more preferably not more than about 1 millimeter and optimally not more than about 0.5 millimeter, from a neighboring reservoir center. These dimensions tend to limit the size of the reservoirs to a maximum volume. The reservoirs are constructed to contain typically no more than about 1 mL, preferably no more than about 1 $\mu$L, and optimally no more than about 1 nL, of fluid. To facilitate handling of multiple reservoirs, it is also preferred that the reservoirs be substantially acoustically indistinguishable.

Thus, as a general matter of convenience and efficiency, it is desirable to address a large number of reservoirs in a relatively short amount of time, e.g., about one minute, or more preferably, about 10 seconds. Thus, the invention typically allows the acoustic generator to address reservoirs at a rate of at least about 96 reservoirs per minute. Faster address rates of at least about 384, 1536, and 3456 reservoirs per minute are achievable with present day technology as well. Thus, the invention can be operated with most (if not all) well plates that are currently commercially available. Proper implementation of the invention should yield a reservoir address rate of at least about 10,000 reservoirs per minute.

Current commercially available positioning technology allows the acoustic radiation generator to be moved from one reservoir to another, with repeatable and controlled acoustic coupling at each reservoir, in less than about 0.1 second for high performance positioning means and in less than about 1 second for ordinary positioning means. A custom designed system will allow the acoustic radiation generator to be moved from one reservoir to another with repeatable and controlled acoustic coupling in less than about 0.001 second. In order to ensure optimal performance, it is important to keep in mind that there are two basic kinds of motion: pulse and continuous. Pulse motion involves the discrete steps of moving an acoustic radiation generator into position, keeping it stationary while it emits acoustic energy, and moving the generator to the next position; again, using a high performance positioning means allows repeatable and controlled acoustic coupling at each reservoir. Typically, the pulse width is very short and may enable over 10 Hz reservoir transitions, and even over 1000 Hz reservoir transitions. A continuous motion design, on the other hand, moves the acoustic radiation generator and the reservoirs continuously, although not at the same speed. In any case, relative motion between the reservoirs and the acoustic generator can be achieved by moving the reservoirs while holding the generator still, by moving the reservoirs while holding the generator still, or by moving the generator and the reservoirs at different velocities.

All acoustic radiation generators employ a vibrational element or transducer to generate acoustic radiation. Often, a piezoelectric element is employed to convert electrical energy into mechanical energy associated with acoustic radiation. When the device may be adapted to eject fluid droplets from a reservoir, an acoustic ejector may be provided that includes the acoustic radiation generator and a focusing means for focusing acoustic radiation generated by the acoustic radiation generator. Focusing means may exhibit a suitable F-number but are typically about at least about 1 or about 2. Selection criteria for appropriate F-numbers and implementation of devices having a focusing means of a high F-number are discussed in U.S. Pat. No. 6,416,164 to Steams et al.

In addition or in the alternative, the invention may be used to assess the contents of a reservoir. In such a case, the acoustic radiation generator is used in combination with an analyzer for analyzing a characteristic of acoustic radiation generated by the generator and transmitted through the reservoir. By placing the analyzer in radiation receiving relationship to the acoustic radiation generator, the acoustic radiation having interacted with the contents of the reservoir may be analyzed. Additional information relating to acoustic assessment can be found in U.S. Patent Application Publication Nos. 20030101819 and 20030150257, each to Mutz et al.

Although any of a number of different means may be used to deliver the acoustic coupling fluid to the exterior surface of the reservoir, such means typically includes a source of the acoustic coupling fluid in fluid communication with a nozzle having an outlet that opens toward the exterior surface of the reservoir. Often, the acoustic coupling fluid is comprised of water. However, fluids similar to water may be used as well. For example, if the device is constructed for operation with water as an acoustic coupling fluid, the acoustic coupling medium may be comprised of a fluid that exhibits an attenuation coefficient for acoustic radiation of a selected frequency similar to that of water. The selected frequency is typically the operating frequency of the device. For example, if a particular frequency is found to be the optimal frequency for droplet ejection, that frequency may be the selected frequency associated with the attenuation coefficient. Typically, the coupling fluid exhibits an attenuation coefficient for acoustic radiation of a selected frequency that differs from the attenuation coefficient of water at the same frequency by no more than about 10%. Preferably, the difference in attenuation coefficient is no more than about 5%. Optimally, the difference in attenuation coefficient is no more than about 1%. In any case, one of ordinary skill in the art will recognize that fluids having that exhibits a lower degree of acoustic attenuation than water may be advantageously used to reduce the power for acoustic radiation generation. In addition, the acoustic coupling fluid is typically directed to flow from the source to the outlet at a rate sufficient for the acoustic coupling fluid to establish conformal contact with the exterior surface of the reservoir.

In some embodiments, the inventive device includes a collector as well as a means for positioning the nozzle. The collector is placed in fluid-receiving relationship to the exterior surface of the reservoir so as to collect excess acoustic coupling fluid flowing therefrom. For example, the nozzle may be placed directly below the exterior surface of the reservoir such that acoustic coupling fluid emerging from the nozzle is directed upward for conformal contact with the exterior surface of the reservoir. To allow facile collection of the acoustic coupling fluid flowing downward from the exterior reservoir surface, the nozzle may be located within the collector.

The nozzle is typically placed no closer than a predetermined distance from the exterior surface of the reservoir so as to avoid contact between the nozzle and the surface. In addition, some embodiments allow acoustic radiation is propagated through the acoustic coupling fluid in the nozzle and the exterior surface into the reservoir. Thus, a particularly useful design allows the nozzle and the acoustic radiation generator to move along the same axis extending from the exterior surface of the reservoir. Typically, the axis is perpendicular to the exterior surface.

Figure 2:
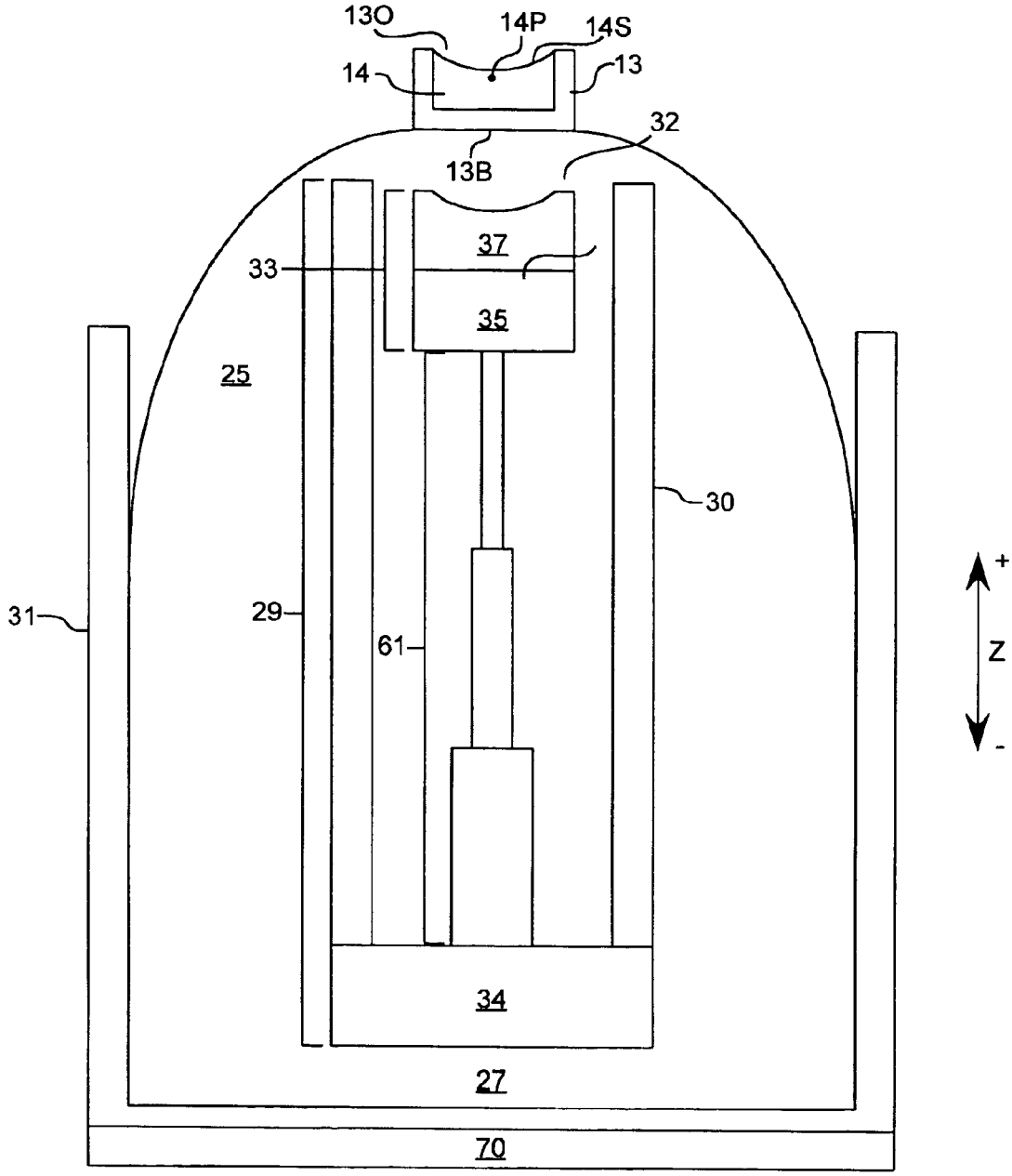
FIG. 2 schematically illustrate in simplified cross-sectional view an device that includes a nozzle located within a collector such that acoustic fluid from the nozzle is collected after contacting a reservoir based by the collector.

FIG. 2 depicts an exemplary acoustic device having a nozzle and collector as described above. As shown, a single reservoir 13 containing a fluid 14 having a fluid surface indicated at 14S. Reservoir 13 has a base indicated at 13B and an opening indicated at 13O. Dispenser 29 provided is comprised of a nozzle 30 that terminates upwardly at an outlet 32 directed toward the reservoir base 13B and downwardly at a pump 34 for pumping acoustic coupling fluid 25 upwardly through the nozzle 30. Located within the nozzle 30 is an acoustic ejector 33 comprised of an acoustic radiation generator 35 for generating acoustic radiation and a focusing means 37 for focusing the acoustic radiation at a focal point within the fluid 14P from which a droplet is to be ejected, near the fluid surface 14S. Positioning means 61 serves to controllably move ejector 33 within nozzle 30 along axis Z. The device also includes a collector 31 for collecting coupling fluid that flows from base 13B. As shown, the nozzle 30 is located within the collector 31. Located at the bottom of the collector 31 and in fluid communication with the pump 34 is a source 27 of acoustic coupling fluid.

In operation, positioning means 70 positions the dispenser 29 at predetermined distance to the reservoir base 13B. The pump 34 draws acoustic coupling fluid from the source 27 and forces the acoustic coupling fluid upward through the nozzle 30. The flow of acoustic coupling emerging from outlet 32 is typically maintained at constant rate and sufficient high to allow the coupling fluid to establish and maintain conformal contact with reservoir base 13B. After contact with reservoir base 13B, acoustic coupling fluid falls back down into collector 31, where the coupling fluid redirected toward source 27 and pump 34 for reuse.

At a constant flow rate, the acoustic coupling fluid 25 between the ejector 33 and the base 13B allows for acoustic radiation generated by the generator 35 to be transmitted therethrough. As a result, acoustic radiation will then travel in a generally upward direction, through base 13B and fluid 14 toward the free fluid surface 14S. The acoustic radiation reflected by free surface 14S may then be analyzed. If needed to ensure that the acoustic radiation is focused near the fluid surface 14S to eject a droplet therefrom, positioning means in the form of telescoping rod 61 may be employed to move ejector 33 to an appropriate location within nozzle 30. For example, the rod 61 may be adapted to elongate in a telescoping manner within the nozzle to move ejector 33 toward the outlet 32. Similarly, the ejector 33 is moved toward pump 34 when rod 61 is retracted. In any case, the ejector 33 may be maintained at a fixed distance from the fluid surface 14S so as to ensure that the acoustic radiation remains focused near the fluid surface 14S as the fluid level in the reservoir 13 is lowered due to the ejection of droplets therefrom.

A number of different designs and mechanisms may be used as a means for eliminating uncontrolled flow of the acoustic coupling fluid. For example, when a nozzle as depicted in FIG. 2 is employed, uncontrolled fluid flow may be avoided simply by immobilizing the relative positions of the reservoir 13 and the nozzle 30 and maintaining fluid flow from outlet 32 at a constant rate. Nevertheless, it should be apparent that any movement of ejector 33 within nozzle 30, particularly rapid movement, may disturb the rate of fluid flow from outlet 32, particularly when the pump 34 moves acoustic fluid at a constant rate. For example, as ejector 33 is moved upward toward outlet 32, the rate of fluid flow emerging from outlet 32 will tend to increase temporarily as rod 61 displaces as coupling fluid within the nozzle 30. Similarly, movement of ejector 33 downward toward pump 34 will cause the rate of fluid flow emerging from outlet 32 to decrease.

Thus, means for eliminating uncontrolled coupling fluid flow from outlet 32, may serve to maintain the fluid pressure at outlet 32 at a constant level. For example, the means for positioning the nozzle and the means for positioning the generator may be synchronized to maintain flow of acoustic coupling fluid from the nozzle at a constant rate, thereby serving as the means for eliminating uncontrolled flow. In addition, a displacement member that maintains the acoustic coupling fluid at a constant volume within the nozzle may be used in response any movement of the acoustic radiation generator within the nozzle. Such displacement members may be selected from pistons, diaphragm, combinations thereof, and other mechanisms. In some instances, the displacement member may be at least partially located within the nozzle. In addition or in the alternative, the displacement member may be at least partially located external to the nozzle in a chamber that fluidly communicates with the nozzle.

A flow rate regulator may be advantageously used to adjust the flow rate of the acoustic coupling fluid from the source to the outlet according to movement of the acoustic radiation generator within the nozzle. For example, an adjustable valve may be provided downstream from the source and upstream from the outlet to adjust the flow rate of the acoustic coupling fluid. Flow rate regulator technology is well known in the art and one of ordinary skill should be able to adapt the inventive device to incorporate such regulators.

Figure 3:
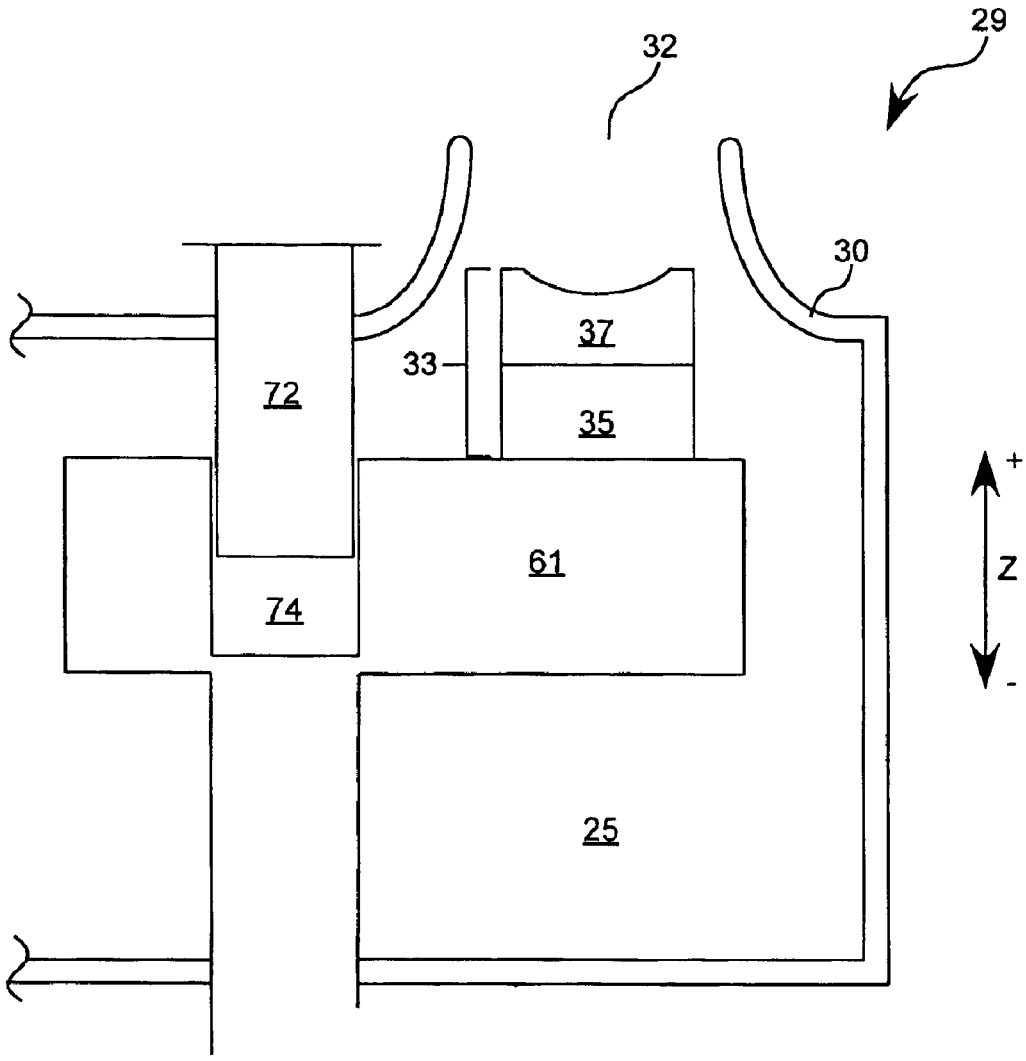
FIG. 3 schematically illustrates in simplified cross-sectional view an acoustic device having a dispenser the employs a stationary opposing piston design.

As discussed above, the means for positioning the acoustic radiation generator may sometime cause uncontrolled flow of the acoustic fluid. Thus, in some instances, an acoustic radiation generator positioning means may be used that has a structure does not substantially alter the volume of the acoustic coupling fluid within the container while positioning the acoustic radiation generator. In such instances, the structure itself serves as the means for eliminating uncontrolled flow of the acoustic coupling fluid. FIG. 3 depicts an exemplary acoustic device that employs a stationary opposing piston design to maintain coupling fluid flow at a constant rate from a nozzle outlet. The opposing piston design operates by maintaining the acoustic coupling fluid at a constant volume within the nozzle. Dispenser 29 provided is comprised of a nozzle 30 that terminates upwardly at an outlet 32 directed upwardly for delivering acoustic coupling fluid 25 to the exterior surface of a reservoir (not shown). Located within the nozzle 30 is an acoustic ejector 33 comprised of an acoustic radiation generator 35 for generating acoustic radiation and a focusing means 37 for focusing the acoustic radiation. Positioning means in the form of a platform 61 serves to move ejector 33 within nozzle 30 along axis Z in a controlled manner. Also provided is a stationary piston 72 that extends through the nozzle 30 and into a corresponding opening 74 in platform 61. As depicted, the volume of acoustic coupling fluid 25 within the nozzle remains constant as ejector 33 is moved along axis Z as long as piston 72 extends through opening 74.

In some instances, a means other than a nozzle may be used to deliver acoustic coupling fluid to the exterior surface of a reservoir. For example, a container may be sealed against the reservoir and filled with the acoustic coupling fluid such that the acoustic coupling fluid is in conformal contact with the exterior surface of the reservoir. In such a case, the acoustic radiation generator may be movable within the container.

Figure 4:
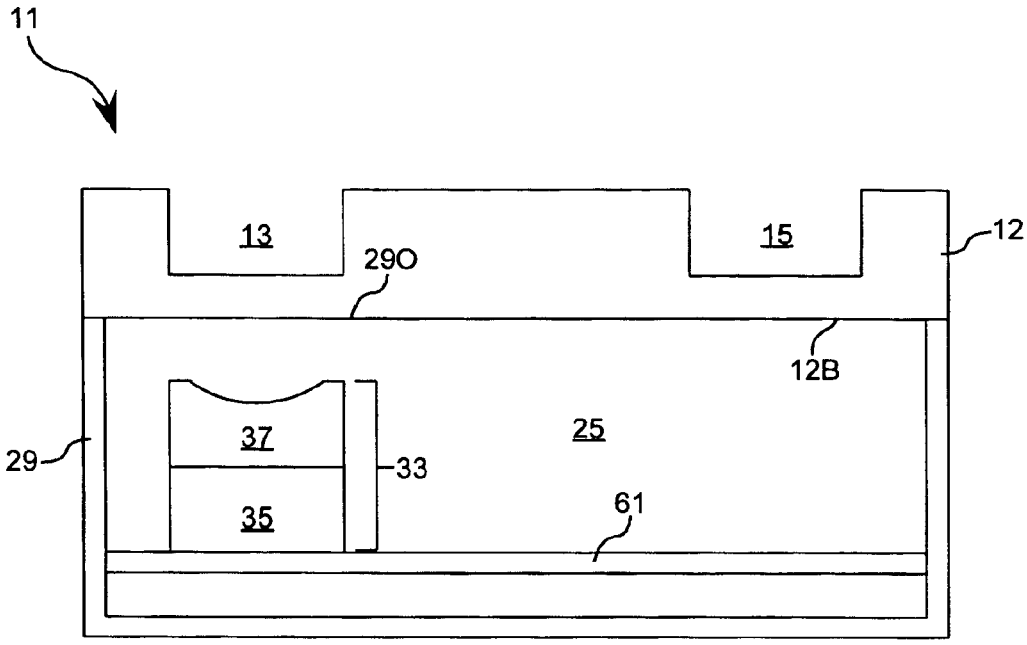
FIG. 4 schematically illustrates in simplified cross-sectional view an acoustic device similar to that of FIG. 1 except that the acoustic ejector and the positioning means are sealed and in a container filled completely with the acoustic coupling fluid.

FIG. 4 depicts an acoustic device similar to that depicted in FIG. 1 with some notable differences relating to the means for eliminating uncontrolled coupling fluid flow. The device 11 includes two attached reservoirs provided in the form of wells 13 and 15 of a well plate 12 wells 13 and 15 share a common underside surface 12B that is substantially planar.

Like the device of FIG. 1, the device of FIG. 4 also includes an acoustic ejector 33 comprised of an acoustic radiation generator 35 for generating acoustic radiation and a focusing means 37 for focusing the acoustic radiation at a focal point within the fluid from which a droplet is to be ejected, near the fluid surface. A positioning means 61 serves to couple the ejector 33 successively to each of the wells.

Unlike the device depicted in FIG. 1, the dispenser is replaced with a container 29 having a base and walls extending upward from the base and terminating at an opening 29O. Completely filled with coupling fluid 25, the container 29 is positioned such that the opening 29O contacts with the underside surface 12B of the well plate 12, thereby forming a seal therebetween. As a result, acoustic ejector 33 and positioning means 61 are both sealed within the container 29 and submerged in coupling fluid 25. Because the volume of the coupling fluid remains 25 unaltered irrespective of the movement and or positioning of the ejector 33 within the container 29, uncontrolled flow of the acoustic coupling fluid at the exterior surface as a result of movement of the acoustic radiation generator is eliminated.

Alternatively, when the movement of the acoustic generator 35 is accompanied by displacement of volume in the container 29, any of the above-described means for eliminating uncontrolled coupling fluid flow associated with the nozzle may be used with the container as well.

From the above, it should be apparent that another embodiment of the invention provides a method for transmitting acoustic radiation into a reservoir. The method involve simultaneously delivering an acoustic coupling fluid to an exterior surface of a reservoir adapted to contain a fluid and positioning an acoustic radiation generator for generating acoustic radiation in acoustic coupling relationship via the acoustic coupling fluid to the reservoir. This is carried out in a manner that avoids uncontrolled flow of the acoustic coupling fluid at the exterior surface. Once the acoustic radiation generator is in position, it is activated so as to generate and transmit acoustic radiation through the exterior surface and into any fluid contained in the reservoir.

The method may be repeated for a plurality of reservoirs. Typically, acoustic coupling is achieved at a rate of at least 1 reservoir per second. In some instances, coupling rates of at least 10 reservoirs per second may be achieved. For high-throughput performance, rates of at least 100 reservoirs per second.

Optionally, radiation transmitted through the reservoir may be analyzed to assess the contents of the reservoir. For example, the contents of the reservoir may be assessed by analyzing a characteristic of acoustic radiation transmitted through the reservoir. In addition or in the alternative, the acoustic radiation may be focused before transmission through the exterior surface and into the reservoir. Focused acoustic radiation may be used to eject a droplet of fluid from the container.

Variations of the present invention will be apparent to those of ordinary skill in the art. For example, any of a number of positioning means known in the art may used with the invention. Such positioning means may be constructed from, e.g., levers, pulleys, gears, a combination thereof, or other mechanical means known to one of ordinary skill in the art. In addition, as alluded to above, positioning means may be used to move items such as the reservoir, the acoustic generator, the coupling fluid delivering means, or a combination thereof, to provide relative motion therebetween. One of ordinary skill in the art will recognize that relative motion may be provided by holding any one or a combination of the items in a fixed position while the allowing the positioning means to move the remaining items. Furthermore, while the invention has been described above in the context of single-element acoustic generator, multiple element acoustic radiation generators such as transducer assemblies may be used as well. That is, linear acoustic arrays, curvilinear acoustic arrays, annular acoustic arrays, phased acoustic arrays, and other transducer assemblies may be used in conjunction with the invention as well. Moreover, since acoustic detectors, like acoustic generators, may be used in conjunction with acoustic coupling fluids, those of ordinary skill in the art will be able to substitute acoustic detectors in place of acoustic generators in certain applications.

It is to be understood that while the invention has been described in conjunction with preferred specific embodiments thereof, the foregoing description is intended to illustrate and not limit the scope of the invention. Other aspects, advantages, and modifications will be apparent to those skilled in the art to which the invention pertains.

All patents, patent applications, journal articles, and other references cited herein are incorporated by reference in their entireties.

We claim:

1. An acoustic device, comprising:

a reservoir adapted to contain a fluid and having an exterior surface;

an acoustic radiation generator for generating acoustic radiation;

a means for delivering an acoustic coupling fluid to the exterior surface of the reservoir;

a means for positioning the acoustic radiation generator in acoustic coupling relationship via the acoustic coupling fluid to the reservoir such that acoustic radiation generated by the acoustic radiation generator is transmitted through the exterior surface and into any fluid contained in the reservoir; and a means for eliminating uncontrolled flow of the acoustic coupling fluid at the exterior surface as a result of movement of the acoustic radiation generator.

2. The device of claim 1, comprising a plurality of reservoirs each adapted to contain a fluid and each having an exterior surface, wherein the means for positioning the acoustic radiation generator is adapted to position the acoustic radiation generator successively in acoustic coupling relationship to each of the reservoirs via the acoustic coupling fluid such that acoustic radiation generated by the acoustic radiation generator is transmitted through the exterior surfaces and into any fluid contained in the reservoirs.

3. The device of claim 2, wherein the reservoirs form a reservoir array.

4. The device of claim 3, wherein the reservoir array is a well plate and each reservoir is a well in the well plate.

5. The device of claim 4, wherein the exterior surface is substantially planar underside surface of the well plate.

6. The device of claim 2, wherein the means for positioning the acoustic radiation generator is adapted to position the acoustic radiation generator successively in acoustic coupling relationship to each of the reservoirs at a rate of at least about 1 reservoir per second.

7. The device of claim 6, wherein the means for positioning the acoustic radiation generator is adapted to position the acoustic radiation generator successively in acoustic coupling relationship to each of the reservoirs at a rate of at least about 10 reservoirs per second.

8. The device of claim 7, wherein the means for positioning the acoustic radiation generator is adapted to position the acoustic radiation generator successively in acoustic coupling relationship to each of the reservoirs at a rate of at least about 100 reservoirs per second.

9. The device of claim 1, comprised of an acoustic ejector that includes the acoustic radiation generator and a focusing means for focusing acoustic radiation generated by the acoustic radiation generator.

10. The device of claim 9, wherein the focusing means exhibits an F-number of at least about 1.

11. The device of claim 10, wherein the focusing means exhibits an F-number of at least about 2.

12. The device of claim 1, comprised of an a means for assessing the contents of the reservoir that includes the acoustic radiation generator and an analyzer for analyzing a characteristic of acoustic radiation generated by the generator and transmitted through the reservoir, wherein the analyzer is situated in radiation receiving relationship to the acoustic radiation generator.

13. The device of claim 1, wherein the means for delivering the acoustic coupling fluid is comprised of a source of the acoustic coupling fluid in fluid communication with a nozzle having an outlet that opens toward the exterior surface of the reservoir, and further wherein the acoustic coupling fluid flows from the source to the outlet at a rate sufficient for the acoustic coupling fluid to establish conformal contact with the exterior surface of the reservoir.

14. The device of claim 13, wherein the acoustic coupling fluid is comprised of water.

15. The device of claim 1, wherein the acoustic coupling fluid exhibits an attenuation coefficient for acoustic radiation of a selected frequency that is no greater than the attenuation coefficient of water at the same frequency by more than about 10%.

16. The device of claim 13, further comprising a collector positioned in fluid-receiving relationship to the exterior surface of the reservoir so as to collect excess acoustic coupling fluid flowing therefrom.

17. The device of claim 16, wherein the nozzle is located within the collector.

18. The device of claim 13, wherein the acoustic radiation from the acoustic radiation generator is transmitted through the nozzle.

19. The device of claim 18, further comprising a means for positioning the nozzle relative to the exterior surface of the reservoir.

20. The device of claim 19, wherein the means for positioning the nozzle is capable of placing the nozzle no closer than a predetermined distance from the exterior surface of the reservoir.

21. The device of claim 20, wherein the means for positioning the acoustic radiation generator maintains the generator at a fixed distance from a free fluid surface within the reservoir while the generator is in acoustic coupling relationship to the reservoir.

22. The device of claim 19, wherein the nozzle and the acoustic radiation generator are movable along the same axis extending from the exterior surface of the reservoir.

23. The device of claim 22, wherein the axis is perpendicular to the exterior surface.

24. The device of claim 18, wherein the means for eliminating uncontrolled flow of the acoustic coupling fluid comprises a displacement member that maintains the acoustic coupling fluid at a constant volume within the nozzle in response any movement of the acoustic radiation generator within the nozzle.

25. The device of claim 24, wherein the displacement member is a piston.

26. The device of claim 24, wherein the displacement member is a diaphragm.

27. The device of claim 24, wherein the displacement member is at least partially located within the nozzle.

28. The device of claim 24, wherein the displacement member is at least partially located external to the nozzle in a chamber that fluidly communicates with the nozzle.

29. The device of claim 18, wherein the means for eliminating uncontrolled flow of the acoustic coupling fluid is comprised of a flow rate regulator that adjusts the flow rate of the acoustic coupling fluid from the source to the outlet according to movement of the acoustic radiation generator within the nozzle.

30. The device of claim 29, wherein the flow rate regulator is comprised of an adjustable valve located downstream from the source and upstream from the outlet.

31. The device of claim 1, wherein the means for delivering the acoustic coupling fluid is comprised of a container sealed against the reservoir and filled with the acoustic coupling fluid such that the acoustic coupling fluid is in conformal contact with the exterior surface of the reservoir, and further wherein the acoustic radiation generator is movable within the container.

32. The device of claim 31, wherein the acoustic coupling fluid is comprised of water.

33. The device of claim 31, wherein the acoustic coupling fluid exhibits an attenuation coefficient for acoustic radiation of a selected frequency that differs from the attenuation coefficient of water at the same frequency by no more than about 10%.

34. The device of claim 31, wherein the means for eliminating uncontrolled flow of the acoustic coupling fluid comprises a displacement member that maintains the acoustic coupling fluid at a constant volume within the container in response to movement of the acoustic radiation generator within the nozzle.

35. The device of claim 34, wherein the displacement member is a piston.

36. The device of claim 34, the displacement member is a diaphragm.

37. The device of claim 34, wherein the displacement member is at least partially located within the container.

38. The device of claim 34, wherein the displacement member is at least partially located external to the container in a chamber that fluidly communicates with the nozzle.

39. The device of claim 31, wherein the means for positioning the acoustic radiation generator has a structure does not substantially alter the volume of the acoustic coupling fluid within the container while positioning the acoustic radiation generator, and the structure serves as the means for eliminating uncontrolled flow of the acoustic coupling fluid.

40. A device for acoustically ejecting fluids from a plurality of reservoirs, comprising:

a plurality of reservoirs each adapted to contain a fluid and each having an exterior surface;

an ejector for ejecting droplets from the reservoirs, comprising an acoustic radiation generator for generating acoustic radiation and a focusing means for focusing the acoustic radiation generated;

a means for delivering an acoustic coupling fluid to the exterior surface of at least one of the reservoirs;

a means for positioning the ejector in acoustic coupling relationship via the acoustic coupling fluid to the at least one reservoir such that acoustic radiation generated by the acoustic radiation generator and focused by the focusing means is transmitted through the exterior surface and into any fluid contained in the at least one reservoir so as to eject a droplet therefrom; and a means for eliminating uncontrolled flow of the acoustic coupling fluid at the exterior surface as a result of movement of the acoustic radiation generator.

41. The device of claim 40, wherein the means for positioning the ejector is constructed to position the ejector so as to establish acoustic coupling of the ejector to a plurality of reservoirs successively at a rate of at least 1 reservoir per second.

42. The device of claim 41, wherein the means for positioning the ejector is constructed to position the ejector so as to establish acoustic coupling of the ejector to a plurality of reservoirs successively at a rate of at least 10 reservoirs per second.

43. The device of claim 42, wherein the means for positioning the ejector is constructed to position the ejector so as to establish acoustic coupling of the ejector to a plurality of reservoirs successively at a rate of at least 100 reservoirs per second.

44. The device of claim 40, wherein the means for delivering the acoustic coupling fluid is comprised of a source of the acoustic coupling fluid in fluid communication with a nozzle having an outlet that opens toward the exterior surface of the reservoir, and further wherein the acoustic coupling fluid flows from the source to the outlet at a rate sufficient for the acoustic coupling fluid to establish conformal contact with the exterior surface of the at least one reservoir.

45. The device of claim 44, further comprising a means for positioning the nozzle relative to the exterior surface of the reservoir.

46. The device of claim 45, wherein the means for positioning the nozzle and the means for positioning the ejector are synchronized to maintain flow of acoustic coupling fluid from the nozzle at a constant rate, thereby serving as the means for eliminating uncontrolled flow.

47. A method for transmitting acoustic radiation into a reservoir, comprising:

(a) delivering an acoustic coupling fluid to an exterior surface of a reservoir adapted to contain a fluid;

(b) positioning an acoustic radiation generator for generating acoustic radiation in acoustic coupling relationship via the acoustic coupling fluid to the reservoir; and (c) activating the acoustic radiation generator so as to generate and transmit acoustic radiation through the exterior surface and into any fluid contained in the reservoir, wherein steps (a) and (b) are carried out simultaneously in a manner that avoids uncontrolled flow of the acoustic coupling fluid at the exterior surface.

48. The method of claim 47, wherein steps (a) and (b) are repeated for an additional reservoir.

49. The method of claim.48, wherein step (a) and (b) are repeated at a rate of at least 1 reservoir per second.

50. The method of claim 49, wherein steps (a) and (b) are repeated at a rate of at least 10 reservoirs per second.

51. The method of claim 50, wherein steps (a) and (b) are repeated at a rate of at least 100 reservoirs per seconds.

52. The method of claim 47, wherein the acoustic radiation generated in step (c) is focused before transmitted through the exterior surface of the reservoir.

53. The method of claim 52, wherein the focused acoustic radiation ejects a droplet of fluid from the reservoir.

54. The method of claim 47, further comprising assessing the contents of the reservoir by analyzing a characteristic of acoustic radiation transmitted through the reservoir.

55. The method of claim 47, wherein step (a) is carried out by transporting the acoustic coupling fluid from a source of the acoustic coupling fluid through an outlet of a nozzle that opens toward the exterior surface of the reservoir at a flow rate sufficient for the acoustic coupling fluid to establish conformal contact with the exterior surface of the reservoir.

56. The method of claim 55, further comprising (d) collecting excess acoustic coupling fluid flowing from nozzle.

57. The method of claim 55, wherein the flow rate is substantially constant.

58. The method of claim 47, wherein step (a) is carried out by sealing a container containing the acoustic radiation generator and filled with the acoustic coupling fluid such that the acoustic coupling fluid is in conformal contact with the exterior surface of the reservoir.

59. A method for ejecting a droplet of fluid from each of a plurality of reservoirs, each containing a fluid, comprising:

(a) delivering an acoustic coupling fluid to an exterior surface of a reservoir adapted to contain a fluid;

(b) positioning an acoustic radiation generator for generating acoustic radiation in acoustic coupling relationship via the acoustic coupling fluid to the reservoir;

(c) activating the acoustic radiation generator to generate acoustic radiation;

(d) focusing and transmitting acoustic radiation through the exterior surface and into the reservoir so as to eject therefrom a droplet of fluid contained in the reservoir; and (e) repeating steps (a) through (d) for at least one different reservoir, wherein steps (a) and (b) are carried out simultaneously in a manner that avoids uncontrolled flow of the acoustic coupling fluid at the exterior surface.

60. The method of claim 59, wherein coupling fluid flow is delivered to the exterior surface at a constant flow rate during steps (b), (c), and (d).

* * * * *